US010123133B2

(12) United States Patent
Pontoppidan et al.

(10) Patent No.: US 10,123,133 B2
(45) Date of Patent: Nov. 6, 2018

(54) LISTENING DEVICE COMPRISING AN INTERFACE TO SIGNAL COMMUNICATION QUALITY AND/OR WEARER LOAD TO WEARER AND/OR SURROUNDINGS

(71) Applicant: Oticon A/S, Smørum (DK)

(72) Inventors: Niels Henrik Pontoppidan, Smørum (DK); Renskje K. Hietkamp, Smørum (DK); Lisbeth Dons Jensen, Smørum (DK); Thomas Lunner, Smørum (DK); Karsten Bo Rasmussen, Smørum (DK)

(73) Assignee: OTICON A/S, Smørum (DK)

( * ) Notice: Subject to any disclaimer, the term of this patent is extended or adjusted under 35 U.S.C. 154(b) by 296 days.

(21) Appl. No.: 14/087,660

(22) Filed: Nov. 22, 2013

(65) Prior Publication Data

US 2014/0146987 A1 May 29, 2014

Related U.S. Application Data

(60) Provisional application No. 61/729,430, filed on Nov. 23, 2012.

(30) Foreign Application Priority Data

Nov. 23, 2012 (EP) ..... 12193992

(51) Int. Cl.
*H04R 25/02* (2006.01)
*H04R 25/00* (2006.01)
*G10L 25/60* (2013.01)

(52) U.S. Cl.
CPC ..... *H04R 25/50* (2013.01); *H04R 25/02* (2013.01); *H04R 25/30* (2013.01); *G10L 25/60* (2013.01)

(58) Field of Classification Search
CPC ..... H04R 25/50; H04R 25/30; H04R 25/02; H04R 25/505; H04R 25/70; H04R 25/507;
(Continued)

(56) References Cited

U.S. PATENT DOCUMENTS 8,213,650 B2 * 7/2012 Frohlich ..... H04R 25/70 381/312
2002/0150219 A1 * 10/2002 Jorgenson et al. ..... 379/73
(Continued)

FOREIGN PATENT DOCUMENTS

EP 2 023 668 A2 2/2009
EP 2 571 289 A2 3/2013
(Continued)

OTHER PUBLICATIONS

Mesgarani et al., "Selective cortical representation or attended speaker in multi-talker speech perception," Nature, vol. 485, May 10, 2012, pp. 233-237.
(Continued)

*Primary Examiner* — Fan Tsang
*Assistant Examiner* — Angelica M McKinney
(74) *Attorney, Agent, or Firm* — Birch, Stewart, Kolasch & Birch, LLP

(57) ABSTRACT

A listening device processes an electric input sound signal and provides an output stimulus perceivable to a wearer of the listening device as sound, the listening device comprising a signal processing unit for processing an information signal originating from the electric input sound signal and to provide a processed output signal forming the basis for generating said output stimulus. A perception unit establishes a perception measure indicative of the wearer's pres-
(Continued)

ent ability to perceive said information signal. A signal interface communicates the perception measure to another person or device.

28 Claims, 6 Drawing Sheets

(58) Field of Classification Search
CPC ... G10L 25/60; A61B 5/04845; A61B 5/0006; H04M 1/0208; G06K 9/00496
USPC ..... 379/202.1; 381/314, 60, 323, 23.1, 58, 381/68, 68.3
See application file for complete search history.

(56) References Cited

U.S. PATENT DOCUMENTS

2003/0109286 A1* 6/2003 Hack ..... H04M 1/0208 455/566
2007/0112277 A1* 5/2007 Fischer ..... A61B 5/0006 600/544
2007/0147641 A1 6/2007 Platz
2007/0173699 A1* 7/2007 Mathan ..... G06K 9/00496 600/300
2008/0008343 A1* 1/2008 Husung ..... H04R 25/65 381/322
2008/0036574 A1 2/2008 Andersen
2009/0028362 A1* 1/2009 Frohlich et al. ..... 381/309
2009/0129615 A1* 5/2009 Kasanmascheff .... H04R 25/305 381/322
2010/0196861 A1* 8/2010 Lunner ..... H04R 25/505 434/112
2012/0143526 A1* 6/2012 Benzel ..... A42B 3/046 702/42
2012/0177233 A1* 7/2012 Kidmose ..... A61B 5/04845 381/314
2013/0101128 A1* 4/2013 Lunner ..... H04R 25/30 381/60

FOREIGN PATENT DOCUMENTS

WO WO 2011/006681 A1 1/2011
WO WO 2012/152323 A1 11/2012

OTHER PUBLICATIONS

Lan et al., "Channel Selection and Feature Projection for Cognitive Load Estimation Using Ambulatory EEG", Computational Intelligence and Neuroscience, vol. 2007, Article ID 74895, pp. 1-12.
Wolpaw et al., "Brain-computer interfaces for communication and control", Clinical Neurophysiology, vol. 113, 2002, pp. 767-791.

* cited by examiner

LISTENING DEVICE COMPRISING AN INTERFACE TO SIGNAL COMMUNICATION QUALITY AND/OR WEARER LOAD TO WEARER AND/OR SURROUNDINGS

TECHNICAL FIELD

The present application relates to listening devices, and to the communication between a wearer of a listening device and another person, in particular to the quality of such communication as seen from the wearer's perspective. The disclosure relates specifically to a listening device for processing an electric input sound signal and for providing an output stimulus perceivable to a wearer as sound, the listening device comprising a signal processing unit for processing an information signal originating from the electric input sound signal.

The application also relates to the use of a listening device and to a listening system. The application furthermore relates to a method of operating a listening device, and to a data processing system comprising a processor and program code means for causing the processor to perform at least some of the steps of the method.

Embodiments of the disclosure may e.g. be useful in applications involving hearing aids, headsets, ear phones, active ear protection systems and combinations thereof.

BACKGROUND

The following account of the prior art relates to one of the areas of application of the present application, hearing aids.

When not accustomed to communicate with hearing impaired listeners, people struggle with how they should preferably speak when they are not familiar with signs that indicate hearing difficulties, and therefore it is very difficult for them to assess whether the way they speak benefits the hearing impaired.

Listening devices for compensating a hearing impairment (e.g. a hearing instrument) or for being worn in difficult listening situations (e.g. a hearing protection device) do not in general display the quality of the signal that reaches the listening device or display the quality of the wearer's speech reception to the wearer or to those people that the wearer communicates with.

Consequently it is difficult for communication partners to adapt their communication with a wearer of listening device(s) in a given situation, without discussing the communication quality explicitly.

A state of the art hearing instrument processes the incoming audio signal based on audiological data such as audiogram data, occlusion sensitivity and perhaps cognitive skills. The signal processing is typically determined by a number of processing algorithms such as compression, noise reduction, digital feedback cancellation in a manner determined once and for all according to these audiological input data. Hence, the processing may depend on the level in different acoustic frequency bands and to some extent on the sound environment (exemplified by the presence of a human voice, of wind noise, etc.) but not on the interaction effects between for instance the spectral content of the voice signal present at a given time and the prevailing wind or background noise.

US 2007/147641 A1 describes a hearing system comprising a hearing device for stimulation of a user's hearing, an audio signal transmitter, an audio signal receiver unit adapted to establish a wireless link for transmission of audio signals from the audio signal transmitter to the audio signal receiver unit, the audio signal receiver unit being connected to or integrated within the hearing device for providing the audio signals as input to the hearing device. The system is adapted—upon request—to wirelessly transmit a status information signal containing data regarding a status of at least one of the wireless audio signal link and the receiver unit, and comprises means for receiving and displaying status information derived from the status information signal to a person other than said user of the hearing device.

US 2008/036574 A1 describes a class room or education system where a wireless signal is transmitted from a transmitter to a group of wireless receivers and whereby the wireless signal is received at each wireless receiver and converted to an audio signal which is served at each wearer of a wireless receiver in a form perceivable as sound. The system is configured to provide that each wireless receiver intermittently flashes a visual indicator, when a wireless signal is received. Thereby an indication that the wirelessly transmitted signal is actually received by a given wireless receiver is conveyed to a teacher or another person other than the wearer of the wireless receiver.

Both documents describe examples where a listening device measures the quality of a signal received via a wireless link, and issues an indication signal related to the received signal.

EP2023668A2 describes a hearing device comprising a perceptive model implemented in a signal processing unit. A psychoacoustic variable related to an output signal to the user from the hearing aid, such as the loudness of the output signal, as determined by the perceptive model is transmitted to a remote control for visualization to allow a caring person to evaluate the cognition of the wearer of the output signal from the hearing device.

WO2012152323A1 relates to public address systems or other systems for emitting audio signals, like music, speech or announcements, in different locations like supermarkets, schools, universities, auditoriums. WO2012152323A1 describes a system for emitting and especially controlling an audio signal in an environment using an objective intelligibility measure. The system comprises an analyzing module for analyzing an acoustic signal from the environment and for providing an intelligibility measure from an objective intelligibility measure method, whereby the intelligibility measure is used as a feedback signal. The feedback signal may for example be coupled back to the system in order to improve or control the intelligibility of the acoustic signal.

SUMMARY

Preferably, a listening device should signal the communication quality, i.e. how well the speech that reaches the wearer is received, to the communication partner(s). By utilizing a visual communication modality, the signaling of the quality will not disturb the spoken communication. Preferably, the listening device should communicate the communication quality to the wearer of the listening device, e.g. to indicate how the current conditions for understanding a spoken message are (e.g. bad, acceptable, good, excellent).

Ongoing measurement and display of the communication quality allows the communication partner to adapt the speech production to the wearer of the listening device(s). Most people will intuitively know that they can speak louder, clearer, slower, etc., if information is conveyed to them (e.g. by the listening device or to a device available for the communication partner) that the speech quality is insufficient. Similarly, the wearer of the listening device may improve his or her position relative to a speaker or change a hearing program or otherwise improve the conditions for perception of the target signal.

The communication quality can be measured indirectly from the audio signals in the listening device (e.g. by one or more detectors or analyzing units) or more directly from the wearers brain signals (see e.g. EP 2 200 347 A2).

The indirect measurement of communication quality can be achieved by performing online comparison of relevant objective measures that correlate to the ability to understand and segregate speech, e.g. the signal to noise ratio (SNR), or the ratio of the speech envelope power and the noise envelope power at the output of a modulation filterbank, denoted the modulation signal-to-noise ratio ($SNR_{MOD}$) (cf. [Jorgensen & Dau; 2011]), the difference in fundamental frequency $F_0$ for concurrent speech signals (cf. e.g. [Binns and Culling; 2007], [Vongpaisal and Pichora-Fuller; 2007]), the degree of spatial separation, etc. Comparing the objective measures to the corresponding individual thresholds, the listening device can estimate the communication quality and display this to a communication partner.

The knowledge of which objective measures that causes the decreased communication quality can also be communicated to the communication partner, e.g. speaking too fast, with too/high pitch, etc.

A more direct measurement is available when the listening device measures the brain activity of the wearer, e.g. via EEG (electroencephalogram) signals picked up by electrodes located in the ear canal (see e.g. EP 2 200 347 A2). This interface enables the listening device to measure how much effort the listener uses to segregate and understand the present speech and noise signals. The effort that the user puts into segregating the speech signals and recognizing what is being said is e.g. estimated from the cognitive load, e.g. the higher the cognitive load the higher the effort, and the lower is the quality of the communication.

Using the wearer's effort instead of (or in addition to) measurements on the audio signals, the communication quality estimation becomes sensitive to other communication modalities such as lip-reading, other gestures, and how fresh or tired the wearer is. Obviously, a communication quality estimation based on such other communication modalities may be different from a communication quality estimation based on measurements on audio signals. In a preferred embodiment, the estimate of communication quality is based on indirect as well as direct measures, thereby providing an overall perception measure.

The measurement of the wearer's brain signals also enable the listening device to estimate which signal the wearer attends to. Recently, [Mesgarani and Chang; 2012] and [Lunner; 2012] have found salient spectral and temporal features of the signal that the wearer attends to in non-primary human cortex. Furthermore, [Pasley et al; 2012] have reconstructed speech from human auditory cortex. When the listening device compares the salient spectral and temporal features in the brain signals with the speech signals that the listening device receives, the hearing device can estimate which signal, and how well a certain signal is transmitted from the hearing device to the wearer.

The latter can be further utilized for educational purposes where a signal that an individual pupil attend to can be compared to the teacher's speech signal, to (possibly) signal lack of attention. This, together with the teaching of the aforementioned US 2008/036574 A1, enables the monitoring of the individual steps in a transmission chain, including the quality of a talker's (e.g. a teacher's) speech signal, the quality of involved wireless links, and finally the user's (e.g. a pupil's) processing of the received speech signal.

The same methodology may be utilized to display the communication quality when direct visual contact between communication partners is not available (e.g. via operationally connected devices, e.g. via a network).

The output of the communication quality estimation process can e.g. be communicated as side-information in a telephone call (e.g. a VoIP call) and be displayed at the other end (by a communication partner).

An object of the present application is to provide an indication to a communication partner of a listening device wearer's present ability of perceiving an information (speech) signal from said communication partner and/or to the wearer her- or himself. Another object of the disclosure is to dynamically adapt the signal processing of the listening device to maximize a user's perception of a current input signal.

Definitions

In the present context, a "listening device" refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A "listening device" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The listening device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The listening device may comprise a single unit or several units communicating electronically with each other.

More generally, a listening device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some listening devices, an amplifier may constitute the signal processing circuit. In some listening devices, the output means may comprise an output transducer, such as e.g. a loudspeaker for providing an air-borne acoustic signal or a vibrator for providing a structure-borne or liquid-borne acoustic signal. In some listening devices, the output means may comprise one or more output electrodes for providing electric signals.

In the present application the term 'user' is used interchangeably with the term 'wearer' of a listening device to indicate the person that is currently wearing the listening device or whom it is intended to be worn by.

In the present context, the term 'information signal' is intended to mean an electric audio signal (e.g. comprising frequencies in an audible frequency range). An 'information signal' typically comprises information perceivable as speech by a human being.

The term 'a signal originating from' is in the present context taken to mean that the resulting signal 'includes' (such as is equal to) or 'is derived from' (e.g. by demodulation, amplification or filtering, addition or subtraction) the original signal.

In the present context, the term 'communication partner' is used to define a person with whom the person wearing the listening device presently communicates, and to whom a perception measure indicative of the wearer's present ability to perceive information is conveyed.

Objects of the application are achieved by the invention described in the accompanying claims and as described in the following.

A Listening Device:

In an aspect, an object of the application is achieved by a listening device for processing an electric input sound signal and to provide an output stimulus perceivable to a wearer of the listening device as sound, the listening device comprising a signal processing unit (forming part of a forward path) for processing an information signal originating from the electric input sound signal and to provide a processed output signal forming the basis for generating said output stimulus. The listening device further comprises a perception unit for establishing a perception measure indicative of the wearer's present ability to perceive said information signal, and a signal interface for communicating said perception measure to another person or to an auxiliary device.

This has the advantage of allowing an information delivering person (a communication partner) to adjust his or her behavior relative to an information receiving person wearing a listening device to thereby increase the listening device wearer's chance of perceiving an information signal from the information delivering person. It may in an embodiment further allow the wearer to adjust his or her behavior relative to the information delivering person and/or to change a functionality of the listening device depending on the perception measure to improve the wearer's chance of perceiving the information signal. It may in an embodiment further allow the listening device to automatically change a functionality of the listening device or the processing of the input sound signal depending on the perception measure to thereby improve the wearer's chance of perceiving the information signal.

In an embodiment, the listening device is adapted to extract the information signal from the electric input sound signal.

In an embodiment, the signal processing unit is adapted to enhance the information signal. In an embodiment, the signal processing unit is adapted to process said information signal according to a wearer's particular needs, e.g. a hearing impairment, the listening device thereby providing functionality of a hearing instrument. In an embodiment, the signal processing unit is adapted to apply a frequency dependent gain to the information signal to compensate for a hearing loss of a user. Various aspects of digital hearing aids are described in [Schaub; 2008].

In an embodiment, the listening device comprises a load estimation unit for providing an estimate of present cognitive load of the wearer. In an embodiment, the listening device is adapted to influence the processing of said information signal in dependence of the estimate of the present cognitive load of the wearer. In an embodiment, the listening device comprises a control unit operatively connected to the signal processing unit and to the perception unit and configured to control the signal processing unit depending on the perception measure. In a practical embodiment, the control unit is integrated with or form part of the signal processing unit (unit DSP' in FIG. 1). Alternatively, the control unit may be integrated with or form part of the load estimation unit (cf. unit 'P-estimator' in FIG. 1).

In an embodiment, the perception unit is configured to use the estimate of present cognitive load of the wearer in the determination of the perception measure. In an embodiment, the perception unit is configured to exclusively base the estimate of present cognitive load of the wearer in the determination of the perception measure.

In an embodiment, the listening device comprises an ear part adapted for being mounted fully or partially at an ear or in an ear canal of a user, the ear part comprising a housing, and at least one electrode (or electric terminal) located at a surface of said housing to allow said electrode(s) to contact the skin of a user when said ear part is operationally mounted on the user. Preferably, the at least one electrode is adapted to pick up a low voltage electric signal from the user's skin. Preferably, the at least one electrode is adapted to pick up a low voltage electric signal from the user's brain. In an embodiment, the listening device comprises an amplifier unit operationally connected to the electrode(s) and adapted for amplifying the low voltage electric signal(s) to provide amplified brain signal(s). In an embodiment, the low voltage electric signal(s) or the amplified brain signal(s) are processed to provide an electroencephalogram (EEG). In an embodiment, the load estimation unit is configured to base the estimate of present cognitive load of the wearer on said brain signals.

In an embodiment, the listening device comprises an input transducer for converting an input sound to the electric input sound signal. In an embodiment, the listening device comprises a directional microphone system adapted to enhance a 'target' acoustic source among a multitude of acoustic sources in the local environment of the user wearing the listening device. In an embodiment, the directional system is adapted to detect (such as adaptively detect) from which direction a particular part of the microphone signal originates.

In an embodiment, the listening device comprises a source separation unit configured to separate the electric input sound signal in individual electric sound signals each representing an individual acoustic source in the current local environment of the user wearing the listening device. Such acoustic source separation can be performed (or attempted) by a variety of techniques covered under the subject heading of Computational Auditory Scene Analysis (CASA). CASA-techniques include e.g. Blind Source Separation (BSS), semi-blind source separation, spatial filtering, and beamforming. In general such methods are more or less capable of separating concurrent sound sources either by using different types of cues, such as the cues described in Bregman's book [Bregman, 1990] (cf. e.g. pp. 559-572, and pp. 590-594) or as used in machine learning approaches [e.g. Roweis, 2001].

In an embodiment, the listening device is configured to analyze said low voltage electric signals from the user's brain to estimate which of the individual sound signals the wearer presently attends to. The identification of which of the individual sound signals the wearer presently attends to is e.g. achieved by a comparison of the individual electric sound signals (each representing an individual acoustic source in the current local environment of the user wearing the listening device) with the low voltage (possibly amplified) electric signals from the user's brain. The term 'attends to' is in the present context taken to mean 'concentrate on' or 'attempts to listen to perceive or understand'. In an embodiment, 'the individual sound signal that the wearer presently attends to' is termed 'the target signal'.

In an embodiment, the listening device comprises a forward or signal path between an input transducer (microphone system and/or direct electric input (e.g. a wireless receiver)) and an output transducer. In an embodiment, the signal processing unit is located in the forward path. In an embodiment, the listening device comprises an analysis path comprising functional components (e.g. one or more detectors) for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the perception unit is adapted to analyze a signal of the forward path and extract a parameter related to speech intelligibility and to use such parameter in the determination of said perception measure. In an embodiment, such parameter is a speech intelligibility measure, e.g. the speech-intelligibility index (SII, standardized as ANSI S3.5-1997) or other so-called objective measures, see e.g. EP2372700A1. In an embodiment, the parameter relates to an estimate of the current amount of signal (target signal) and noise (non-target signal). In an embodiment, the listening device comprises an SNR estimation unit for estimating a current signal to noise ratio, and wherein the perception unit is adapted to use the estimate of current signal to noise ratio in the determination of the perception measure. In an embodiment, the SNR value is determined for one of (such as each of) the individual electric sound signals (such as the one that the user is assumed to attend to), where a selected individual electric sound signal is the 'target signal' and all other sound signal components are considered as noise.

In an embodiment, the perception unit is configured to use 1) the estimate of present cognitive load of the wearer and 2) an analysis of a signal of the forward path in the determination of the perception measure.

In an embodiment, the perception unit is adapted to analyze inputs from one or more sensors (or detectors) related to a signal of the forward path and/or to properties of the environment (acoustic or non-acoustic properties) of the user or a current communication partner and to use the result of such analysis in the determination of the perception measure. The terms 'sensor' and 'detector' are used interchangeably in the present disclosure and intended to have the same meaning. 'A sensor' (or 'a detector') is e.g. adapted to analyse one or more signals of the forward path (such analysis e.g. providing an estimate of a feedback path, an autocorrelation of a signal, a cross-correlation of two signals, etc.) and/or a signal received from another device (e.g. from and auxiliary device or from a contra-lateral listening device of a binaural listening system). The sensor (or detector) may e.g. compare a signal of the listening device in question and a corresponding signal of the contra-lateral listening device of a binaural listening system. A sensor (or detector) of the listening device may alternatively detect other properties of a signal of the forward path, e.g. a tone, speech (as opposed to noise or other sounds), a specific voice (e.g. own voice), an input level, etc. A sensor (or detector) of the listening device may alternatively or additionally include various sensors for detecting a property of the environment of the listening device or any other physical property that may influence a user's perception of an audio signal, e.g. a room reverberation sensor, a time indicator, a room temperature sensor, a location information sensor (e.g. GPS-coordinates, or functional information related to the location, e.g. an auditorium), e.g. a proximity sensor, e.g. for detecting the proximity of a person or an electromagnetic field (and possibly its field strength), a light sensor, etc. A sensor (or detector) of the listening device may alternatively or additionally include various sensors for detecting properties of the user wearing the listening device, such as a brain wave sensor, a body temperature sensor, a motion sensor, a human skin sensor, etc.

In an embodiment, the perception unit is configured to use the estimate of present cognitive load of the wearer AND one or more of a) the analysis of a signal of the forward path of the listening device, b) the analysis of inputs from one or more sensors (or detectors) related to a signal of the forward path, c) the analysis of inputs from one or more sensors (or detectors) related to properties of the environment of the user, and d) the analysis of inputs from one or more sensors (or detectors) related to properties of the environment of a current communication partner, e) the analysis of a signal received from another device, in the determination of the perception measure.

In an embodiment, the signal interface comprises a light indicator adapted to issue a different light indication depending on the current value of the perception measure. In an embodiment, the light indicator comprises a light emitting diode.

In an embodiment, the signal interface comprises a structural part of the listening device, which changes visual appearance depending on the current value of the perception measure. In an embodiment, the visual appearance is a color or color tone, a form or size. In an embodiment, the structural part comprises a smart material. In an embodiment, the structural part comprises a polymer whose color can be controlled by a voltage indicative of the perception measure.

In an embodiment, the listening device comprises a control unit for analysing signals of the forward path, the control unit being operatively connected to the signal processing unit and to the perception unit and configured to control the signal processing unit depending on the perception measure.

In an embodiment, the control unit is adapted to dynamically optimize the processing of the signal processing unit to maximize speech intelligibility.

In an embodiment, the listening device comprises a memory for storing data, and wherein the listening device is configured to store corresponding values of the perception measure together with one or more classifiers of the current acoustic environment at different points in time. Such data can preferably be logged for later use by an audiologist (e.g. aiming at optimizing signal processing parameters). Preferably, a calculated speech intelligibility measure is logged over time together with classifiers of the corresponding acoustic environment, e.g. wind noise, reverberation signal to noise ratio, voice activity, etc.

In an embodiment, the listening device is adapted to establish a communication link between the listening device and an auxiliary device (e.g. another listening device or an intermediate relay device, a processing device or a display device, e.g. a personal communication device, e.g. a SmartPhone), the link being at least capable of transmitting a perception measure from the listening device to the auxiliary device. In an embodiment, the signal interface comprises a wireless transmitter for transmitting the perception measure (or a processed version thereof) to an auxiliary device for being presented there. The auxiliary device may be a portable device of a communication partner or of the wearer of the listening device.

In an embodiment, the listening device comprises an antenna and transceiver circuitry for wirelessly receiving a direct electric input signal from another device, e.g. a communication device (e.g. a remote control device, e.g. a SmartPhone) or another listening device. In an embodiment, the listening device comprises a (possibly standardized) electric interface (e.g. in the form of a connector) for receiving a wired direct electric input signal from another device or for attaching a separate wireless receiver, e.g. an FM-shoe. In an embodiment, the direct electric input signal represents or comprises an audio signal and/or a control signal. In an embodiment, the direct electric input signal comprises the electric input sound signal (comprising the information signal). In an embodiment, the listening device comprises demodulation circuitry for demodulating the received direct electric input to provide the electric input sound signal (comprising the information signal). In an embodiment, the demodulation and/or decoding circuitry is further adapted to extract possible control signals (e.g. for setting an operational parameter (e.g. volume) and/or a processing parameter of the listening device).

In general, a wireless link established between antenna and transceiver circuitry of the listening device and the other device can be of any type. In an embodiment, the wireless link is used under power constraints, e.g. in that the listening device comprises a portable (typically battery driven) device. In an embodiment, the wireless link is or comprises a link based on near-field communication, e.g. an inductive link based on an inductive coupling between antenna coils of transmitter and receiver parts. In another embodiment, the wireless link is or comprises a link based on far-field, electromagnetic radiation. In an embodiment, the listening device comprises first and second wireless interfaces. In an embodiment, the first wireless interface is configured to establish a first communication link between the listening device and another listening device (the two listening devices e.g. forming part of a binaural listening system). In an embodiment, the second wireless interface is configured to establish a second communication link between the listening device and the auxiliary device. In an embodiment, the first communication link is based on near-field communication. In an embodiment, the second communication link is based on far-field communication. In an embodiment, the communication via the wireless link is arranged according to a specific modulation scheme (preferably at frequencies above 100 kHz), e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying) or QAM (quadrature amplitude modulation). Preferably, a frequency range used to establish communication between the listening device and the other device is located below 50 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the listening device comprises an output transducer for converting an electric signal to a stimulus perceived by the user as sound. In an embodiment, the output transducer comprises a number of electrodes of a cochlear implant or a vibrator of a bone conducting hearing device. In an embodiment, the output transducer comprises a receiver (loudspeaker) for providing the stimulus as an acoustic signal to the user.

In an embodiment, an analogue electric signal representing an acoustic signal is converted to a digital audio signal in an analogue-to-digital (AD) conversion process (by an analogue-to-digital (AD) converter of the listening device), where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the listening device comprises a digital-to-analogue (DA) converter to convert a digital signal to an analogue output signal, e.g. for being presented to a user via an output transducer.

In an embodiment, the listening device, e.g. an input transducer (e.g. a microphone unit and/or a transceiver unit), comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct (possibly overlapping) frequency range of the input signal.

In an embodiment, the listening device comprises a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a listening device as described above, in the 'detailed description of embodiments' and in the claims, is moreover provided. In an embodiment, use is provided in a hearing instrument, a headset, an ear phone, an active ear protection system or a combination thereof In an embodiment, use is provided in a system comprising one or more hearing instruments, headsets, ear phones, active ear protection systems, etc. In embodiment, use of a listening device in a teaching situation or a public address situation, e.g. in an assistive listening system, e.g. in a classroom amplification system, is provided.

A Method:

In an aspect, a method of operating a listening device for processing an electric input sound signal and for providing an output stimulus perceivable to a wearer of the listening device as sound, the listening device comprising a signal processing unit for processing an information signal originating from the electric input sound signal and to provide a processed output signal forming the basis for generating said output stimulus is furthermore provided by the present application. The method comprises a) establishing a perception measure indicative of the wearer's present ability to perceive said information signal, and b) communicating said perception measure to another person or to an auxiliary device.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Listening System:

In a further aspect, a listening system comprising a listening device as described above, in the 'detailed description of embodiments', and in the claims, AND an auxiliary device is moreover provided.

It is intended that some or all of the structural features of the listening device described above, in the 'detailed description of embodiments' or in the claims can be combined with embodiments of the listening system, and vice versa.

In an embodiment, the system is adapted to establish a communication link between the listening device and the auxiliary device to provide that information (e.g. control and status signals, possibly audio signals) can be exchanged or forwarded from one to the other, at least that a perception measure can be transmitted from the listening device to the auxiliary device.

In an embodiment, the auxiliary device comprises a display (or other information) unit to display (or otherwise present) the (possibly further processed) perception measure to a person wearing (or otherwise being in the neighbourhood of) the auxiliary device.

In an embodiment, the auxiliary device is or comprises a personal communication device, e.g. a portable telephone, e.g. a smart phone having the capability of network access and the capability of executing application specific software (Apps), e.g. to display information from another device, e.g. information from the listening device indicative of the wearer's ability to understand a current information signal and/or to control functionality of the listening system, e.g. of the listening device.

In an embodiment, the listening system comprises a pair of listening devices as described above, in the 'detailed description of embodiments', and in the claims, the pair of listening devices constituting a binaural listening system enabling an exchange of information, including audio signals, between them. The listening system is preferably configured to transfer audio data from the listening device with the best predicted speech intelligibility (as indicated by the current perception measure) to the other listening device (via a (e.g. wireless) communication link). This has the advantage that the listening system provides an optimal signal (as regards speech intelligibility) at all times. Preferably such transfer of audio data is performed in a specific audio transfer mode of operation (e.g. selectable by the user, e.g. via a user interface, e.g. via the auxiliary device).

In an embodiment, the auxiliary device is configured to run an APP or similar software for displaying the instantaneous and/or averaged data related to said perception measure and possibly other relevant data, the system being configured to calculate or process such data in the hearing aid, or in the auxiliary device based on data transmitted from the listening device to the auxiliary device. In an embodiment, the auxiliary device is configured to transmit such processed data, e.g. modified processing parameters extracted from such processed data, back to the listening device. In an embodiment, the auxiliary device is configured to indicate (e.g. graphically) to the wearer of the listening device and/or to another person any changes in the perception measure. Thereby any activity of the wearer and/or the other person to improve the perception of the wearer can be immediately evaluated, whereby an improvement of the user's situation is facilitated. In an embodiment, the listening system is configured to display (by the auxiliary device(s)) a current contribution (value) of individual classifiers of the current sound environment to the perception measure (e.g. the level of noise, e.g. of wind noise, the level of the target signal, reverberation, etc.). Thereby a user and/or a communication partner get(s) an indication of specific conditions that may decrease the user's perception, and possibly be able to 'do something about it'.

In an embodiment, the auxiliary device comprises a memory for storing data, and wherein the listening system is configured to transmit said perception measure determined in the listening devices to the auxiliary device and to store said perception measure together with one or more classifiers of the current acoustic environment corresponding to said perception measure in said memory at different points in time. In an embodiment, the one or more classifiers of the current acoustic environment are determined in the auxiliary device, e.g. based on one or more sensors located in the auxiliary device or based on information processed in the auxiliary device (e.g. received from the listening device or another device or server). In an embodiment, the auxiliary device comprises an interface to a network, e.g. the Internet.

In an embodiment, the (wireless) communication link between the listening device and the auxiliary device and/or the (wireless) communication link between the pair of listening devices of the binaural listening system is a link based on near-field communication, e.g. an inductive link based on an inductive coupling between antenna coils of respective transmitter and receiver parts of the two devices. In another embodiment, the wireless link(s) is/are based on far-field, electromagnetic radiation. In an embodiment, the wireless link is based on a standardized or proprietary technology. In an embodiment, the wireless link is based on Bluetooth technology (e.g. Bluetooth Low-Energy technology). In an embodiment, each of the listening devices comprises first and second wireless interfaces. In an embodiment, the first wireless interface is configured to establish a first communication link between the pair of listening devices. In an embodiment, the second wireless interface is configured to establish a second communication link between the listening device and the auxiliary device. In an embodiment, the first communication link is based on near-field communication (e.g. inductive communication). In an embodiment, the second communication link is based on far-field communication (e.g. arranged according to a standard, e.g. Bluetooth, e.g. Bluetooth Low Energy (preferably modified to enable audio communication).

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1A:
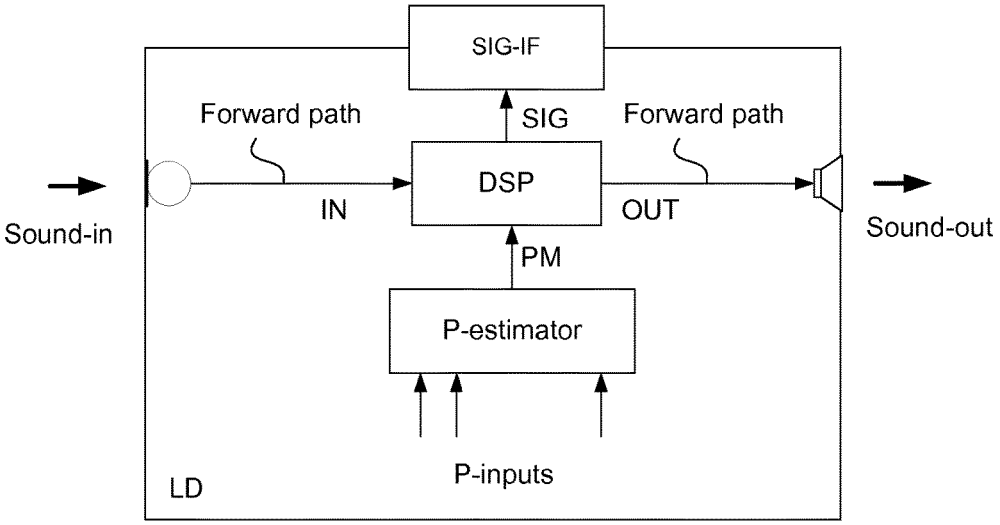
FIGS. 1A, 1B, and 1C show three embodiments of a listening device according to the present disclosure.

FIG. 1 shows three embodiments of a listening device according to the present disclosure. The listening device LD (e.g. a hearing instrument) in the embodiment of FIG. 1A comprises an input transducer (here a microphone unit) for converting an input sound (Sound-in) to an electric input sound signal comprising an information signal IN, a signal processing unit (DSP) for processing the information signal (e.g. according to a user's needs, e.g. to compensate for a hearing impairment) and providing a processed output signal OUT and an output transducer (here a loudspeaker) for converting the processed output signal OUT to an output sound (Sound-out). The signal path between the input transducer and the output transducer comprising the signal processing unit (DSP) is termed the Forward path (as opposed to an 'analysis path' or a 'feedback estimation path' or an (external) 'acoustic feedback path', cf. e.g. FIG. 6). Typically, the signal processing unit (DSP) is a digital signal processing unit. In the embodiment of FIG. 1, the input signal is e.g. converted from analogue to digital form by an analogue to digital (AD) converter unit forming part of the microphone unit (or the signal processing unit DSP) and the processed output is e.g. converted from a digital to an analogue signal by a digital to analogue (DA) converter, e.g. forming part of the loudspeaker unit (or the signal processing unit DSP). In an embodiment, the digital signal processing unit (DSP) is adapted to process the frequency range of the input signal considered by the listening device LD (e.g. between a minimum frequency (e.g. 20 Hz) and a maximum frequency (e.g. 8 kHz or 10 kHz or 12 kHz) in the audible frequency range of approximately 20 Hz to 20 kHz) independently in a number of sub-frequency ranges or bands (e.g. between 2 and 64 bands or more). The listening device LD further comprises a perception unit (P-estimator) for establishing a perception measure PM indicative of the wearer's present ability to perceive an information signal (here signal IN). The perception measure PM is communicated to a signal interface (SIG-IF) (e.g., as in FIG. 1, via the signal processing unit DSP) for signalling an estimate of the quality of reception of an information (e.g. acoustic) signal from a person other than the wearer (e.g. a person in the wearer's surroundings). The perception measure PM from the perception unit (P-estimator) is used (e.g. further processed) in the signal processing unit (DSP) to generate a control signal SIG to signal interface (SIG-IF) to present to the user or to another person or another (auxiliary) device a message indicative of the wearer's current ability to perceive an information message from another person. Additionally or alternatively, the perception measure PM is fed to the signal processing unit (DSP) and e.g. used in the selection of appropriate processing algorithms applied to the information signal IN (e.g. in an adaptive process to maximize the perception measure). The estimation unit receives one or more inputs (P-inputs) relating a) to the received signal (e.g.

its type (e.g. speech or music or noise), its signal to noise ratio, etc.), b) to the current state of the wearer of the listening device (e.g. the cognitive load), and/or c) to the surroundings (e.g. to the current acoustic environment), and based thereon the estimation unit (P-estimator) makes the estimation (embodied in estimation signal PM) of the perception measure. The inputs to the estimation unit (P-inputs) may e.g. originate from direct measures of cognitive load and/or from a cognitive model of the human auditory system, and/or from other sensors or analyzing units regarding the received input electric input sound signal comprising an information signal or the environment of the wearer (cf. FIG. 1B, 1C).

Figure 1B:
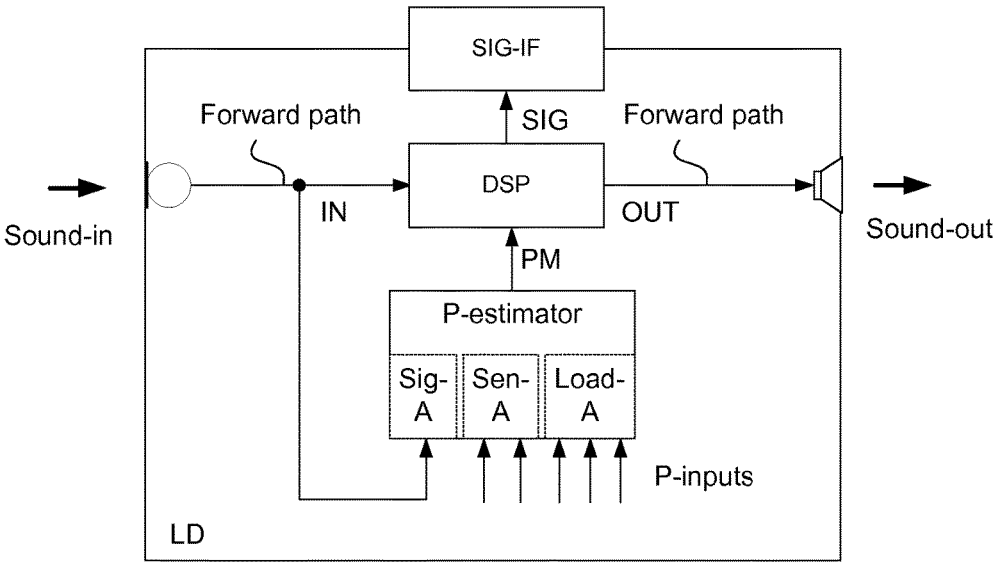

FIG. 1B shows an embodiment of a listening device (LD, e.g. a hearing aid) according to the present disclosure which differs from the embodiment of FIG. 1A in that the perception unit (P-estimator) is indicated to comprise separate analysis or control units for receiving and evaluating P-inputs related to 1) one or more signals of the forward path (here information signal IN), embodied in signal control unit Sig-A, 2) inputs from sensors, embodied in sensor control unit Sen-A, and 3) inputs related to the person's (user's) present mental and/or physical state (e.g. including the cognitive load), embodied in load control unit Load-A.

Figure 1C:
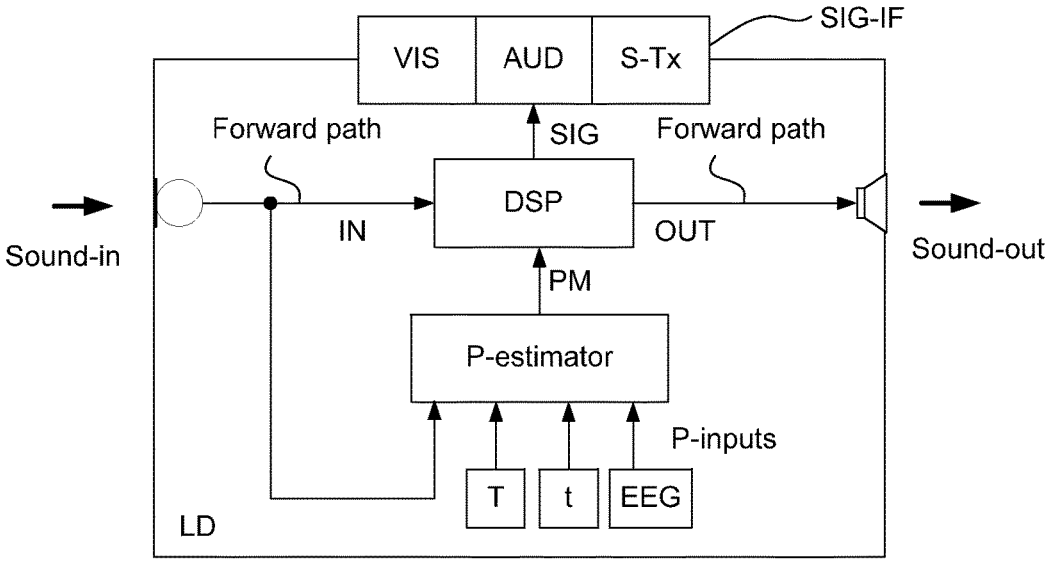

FIG. 1C shows an embodiment of a listening device (LD, e.g. a hearing aid) according to the present disclosure which differs from the embodiment of FIG. 1A in A) that it comprises units for providing specific measurement inputs (e.g. sensors or measurement electrodes) or analysis units providing fully or partially analyzed data inputs to the perception unit (P-estimator) providing a time dependent perception measure PM(t) (t being time) of the wearer based on said inputs and B) that it gives examples of specific interface units forming parts of the signal interface (SIG-IF). The embodiment of a listening device of FIG. 1C comprises measurement or analysis units providing direct measurements of voltage changes of the body of the wearer (e.g. current brain waves) via electrodes mounted on a housing of the listening device (unit EEG), indication of the time of the day and/or a time elapsed (e.g. from the last power-on of the device) (unit t), and current body temperature (unit T). The outputs of the measurement or analysis units provide (P-) inputs to the perception unit. Further the electric input sound signal comprising an information signal IN is connected to the perception unit (P-estimator) as a P-input, where it is analyzed, and where one or more relevant parameters are extracted there from, e.g. an estimate of the current signal to noise ratio (SNR) of the information signal IN. Embodiments of the listening device may contain one or more of the measurement or analysis units for (or providing inputs for) determining current cognitive load of the user or relating to the input signal or to the environment of the wearer of the listening device (cf. FIG. 1B). A measurement or analysis unit may be located in a separate physical body than other parts of the listening device, the two or more physically separate parts being operationally connected (e.g. in wired or wireless contact with each other). Inputs to the measurement or analysis units (e.g. to units EEG or T) may e.g. be generated by measurement electrodes (and corresponding amplifying and processing circuitry) for picking up voltage changes of the body of the wearer (cf. FIG. 2). Alternatively, the measurement or analysis units may comprise or be constituted by such electrodes or electric terminals. The specific features of the embodiment of FIG. 1C are intended to possibly being combined with the features of FIGS. 1A and/or 1B in further embodiments of a listening device according to the present disclosure.

In FIG. 1, the input transducer is illustrated as a microphone unit. It is assumed that the input transducer provides the electric input sound signal comprising the information signal (an audio signal comprising frequencies in the audible frequency range). Alternatively, the input transducer can be a receiver of a direct electric input signal comprising the information signal (e.g. a wireless receiver comprising an antenna and receiver circuitry and demodulation circuitry for extracting the electric input sound signal comprising the information signal). In an embodiment, the listening device comprises a microphone unit as well as a receiver of a direct electric input signal and a selector or mixer unit allowing the respective signals to be individually selected or mixed and electrically connected to the signal processing unit DSP (either directly or via intermediate components or processing units).

Direct measures of the mental state (e.g. cognitive load) of a wearer of a listening device can be obtained in different ways.

Figure 2:
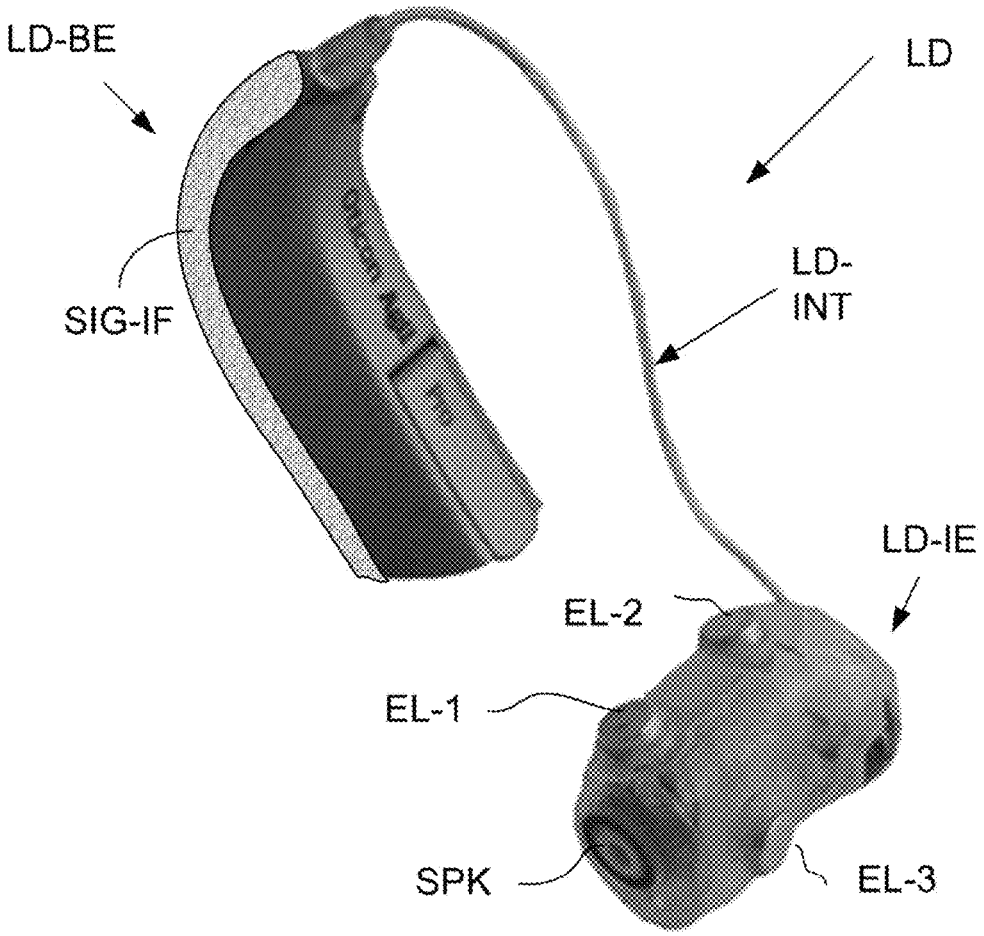
FIG. 2 shows an embodiment of a listening device with an IE-part adapted for being located in the ear canal of a wearer, the IE-part comprising electrodes for picking up small voltages from the skin of the wearer, e.g. brain wave signals.

FIG. 2 shows an embodiment of a listening device with an IE-part adapted for being located in the ear canal of a wearer, the IE-part comprising electrodes for picking up small voltages from the skin of the wearer, e.g. brain wave signals. The listening device LD of FIG. 2 comprises a part LD-BE adapted for being located behind the ear (pinna) of a user, a part LD-IE adapted for being located (at least partly) in the ear canal of the user and a connecting element LD-INT for mechanically (and optionally electrically) connecting the two parts LD-BE and LD-IE. The connecting part LD-INT is adapted to allow the two parts LD-BE and LD-IE to be placed behind and in the ear of a user, respectively, when the listening device is intended to be in an operational state. Preferably, the connecting part LD-INT is adapted in length, form and mechanical rigidity (and flexibility) to allow to easily mount and de-mount the listening device, including to allow or ensure that the listening device remains in place during normal use (i.e. to allow the user to move around and perform normal activities).

The part LD-IE comprises a number of electrodes, preferably more than one. In FIG. 2, three electrodes EL-1, EL-2, EL-3 are shown, but more (or fewer) may be arranged on the housing of the LD-IE part. The electrodes of the listening device are preferably configured to measure cognitive load (e.g. based on ambulatory EEG) or other signals in the brain, cf. e.g. EP 2 200 347 A2, [Lan et al.; 2007], or [Wolpaw et al.; 2002]. It has been proposed to use an ambulatory cognitive state classification system to assess the subject's mental load based on EEG measurements (unit EEG in FIG. 1C). Preferably, a reference electrode is defined. An EEG signal is of low voltage, about 5-100 μV. The signal needs high amplification to be in the range of typical AD conversion, ($\sim 2^{-16}$ V to 1 V, 16 bit converter). High amplification can be achieved by using the analogue amplifiers on the same AD-converter, since the binary switch in the conversion utilises a high gain to make the transition from '0' to '1' as steep as possible. In an embodiment, the listening device (e.g. the EEG-unit) comprises a correction-unit specifically adapted for attenuating or removing artefacts from the EEG-signal (e.g. related to the user's motion, to noise in the environment, irrelevant neural activities, etc.).

Alternatively, or additionally, an electrode may be configured to measure the temperature (or other physical parameter, e.g. humidity) of the skin of the user (cf. e.g. unit T in FIG. 1C). An increased/altered body temperature may indicate an increase in cognitive load. The body temperature may e.g. be measured using one or more thermo elements, e.g. located where the hearing aid meets the skin surface. The relationship between cognitive load and body temperature is e.g. discussed in [Wright et al.; 2002].

In an embodiment, the electrodes may be configured by a control unit of the listening device to measure different physical parameters at different times (e.g. to switch between EEG and temperature measurements).

In another embodiment, direct measures of cognitive load can be obtained through measuring the time of the day, acknowledging that cognitive fatigue is more plausible at the end of the day (cf. unit t in FIG. 1C).

In the embodiment of a listening device of FIG. 2, the LD-IE part comprises a loudspeaker (receiver) SPK. In such case the connecting part LD-INT comprises electrical connectors for connecting electronic components of the LD-BE and LD-IE parts. Alternatively, in case a loudspeaker is located in the LD-BE part, the connecting part LD-INT comprises an acoustic connector (e.g. a tube) for guiding sound to the LD-IE part (and possibly, but not necessarily, electric connectors).

In an embodiment, more data may be gathered and included in determining the perception measure (e.g. additional EEG channels) by using a second listening device (located in or at the other ear) and communicating the data picked up by the second listening device (e.g. an EEG signal) to the first (contra-lateral) listening device located in or at the opposite ear (e.g. wirelessly, e.g. via another wearable processing unit or through local networks, or by wire).

The BTE part comprises a signal interface part SIG-IF adapted to indicate to the user and/or to a communication partner a communication quality of a communication from the communication partner to a wearer of the listening device. In the embodiment of FIG. 2, the signal interface part SIG-IF comprises a structural part of the housing of the BTE part, where the structural part is adapted to change colour or tone to reflect the communication quality. Preferably, the structural part of the housing of the BTE part comprising the signal interface part SIG-IF is visible to the communication partner. In the embodiment of FIG. 2, the signal interface part SIG-IF is implemented as a coating on the structural part of the BTE housing, whose colour or tone can be controlled by an electrical voltage or current. Preferably, a predefined relation between colours corresponding to different values of the perception measure is agreed on with a communication partner (e.g. green=OK, red=difficult, or equivalent).

Figure 3:
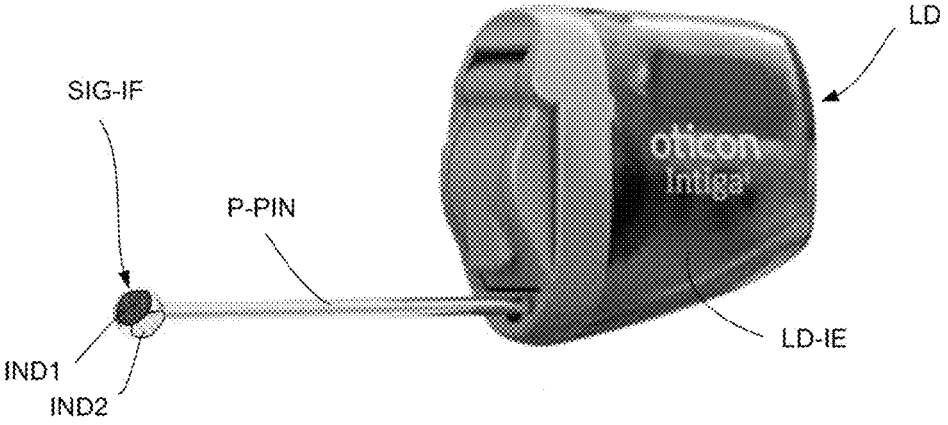
FIG. 3 shows an embodiment of a listening device comprising a first specific visual signal interface according to the present disclosure.

FIG. 3 shows an embodiment of a listening device comprising a first specific visual signal interface according to the present disclosure. The listening device LD comprises a pull-pin (P-PIN) aiding in the mounting and pull out of the listening device LD from the ear canal of a wearer. The pull pin P-PIN comprises signal interface part SIG-IF (here shown to be an end part facing away from the main body (LD-IE) of the listening device (LD) and towards the surroundings allowing a communication partner to see it. The signal interface part SIG-IF is adapted to change colour or tone to reflect a communication quality of a communication from a communication partner to a wearer of the listening device. This can e.g. be implemented by a single Light Emitting Diode (LED) or a collection of LED's with different colours (IND1, IND2). The pull pin may additionally work as an antenna for a wireless interface to an auxiliary device.

In an embodiment, an appropriate communication quality is signalled with one colour (e.g. green, e.g. implemented by a green LED), and gradually changing (e.g. to yellow, e.g. implemented by a yellow LED) to another colour (e.g. red, e.g. implemented by a red LED) as the communication quality decreases. In an embodiment, the listening device LD is adapted to allow a configuration (e.g. by a wearer) of the LD to provide that the indication (e.g. LED's) is only activated when the communication quality is inappropriate to minimize the attention drawn to the device.

Figure 4:
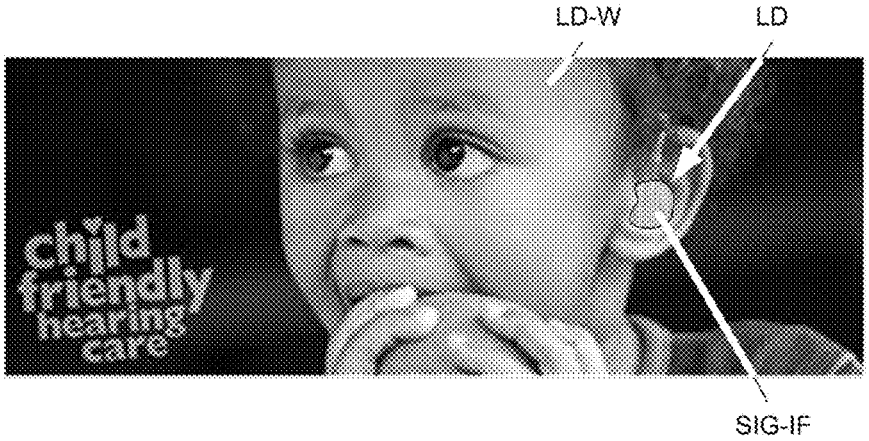
FIG. 4 shows an embodiment of a listening device comprising a second specific visual signal interface according to the present disclosure.

FIG. 4 shows an embodiment of a listening device comprising a second specific visual signal interface according to the present disclosure. The listening device LD of FIG. 4 is a paediatric device, where the signal interface SIG-IF is implemented to provide that the mould changes colour or tone to display a communication quality of a communication from a communication partner. Different colours or tones of the mould (at least of a face of the mould visible to a communication partner) indicate different degrees of perception (different values of a perception measure PM, see e.g. FIG. 1) of the information signal by the wearer LD-W (here a child) of the listening device LD. In an embodiment, the colour of the mould changes from green (indicating high perception) over yellow (indicating medium perception) to red (indicating low perception) as the perception measure correspondingly changes (decreases). The colour changes of the mould are e.g. implemented by integrating coloured LED's into a transparent mould (or by voltage controlled polymers). The colour coding can also be used to signal that different chains of the transmission chain is malfunctioning, e.g. input speech quality, the wireless link, or the attention of the wearer.

Figure 5:
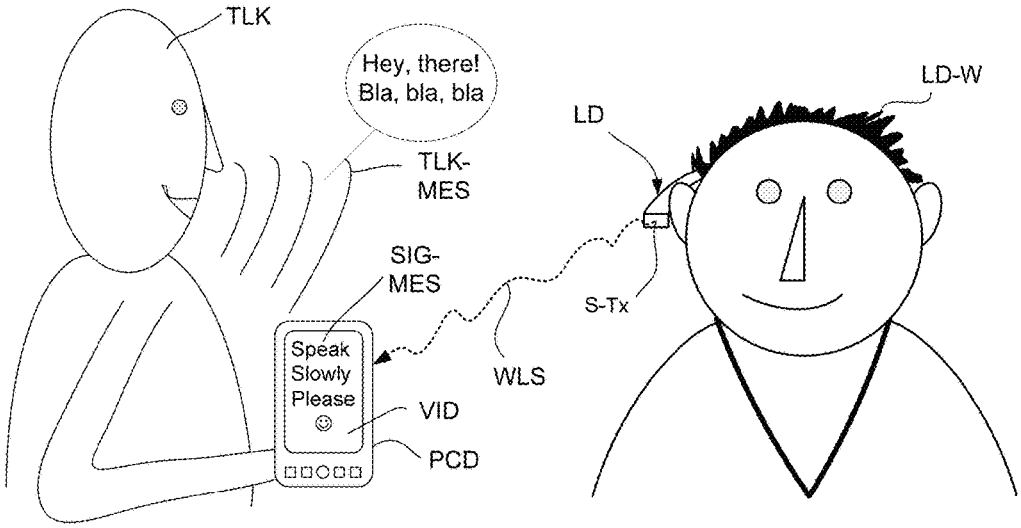
FIG. 5 shows an embodiment of a listening system comprising a third specific visual signal interface according to the present disclosure.

FIG. 5 shows an embodiment of a listening system comprising a third specific visual signal interface according to the present disclosure. FIG. 5 illustrates an application scenario utilizing a listening system comprising a listening device LD worn by a wearer LD-W and an auxiliary device PCD (here in the form of a (portable) personal communication device, e.g. a smart phone) worn by another person (TLK). The listening device LD and the personal communication device PCD are adapted to establish a wireless link WLS between them (at least) to allow a transfer from the listening device to the personal communication device of a perception measure (cf. e.g. PM in FIG. 1) indicative of the degree of perception by the wearer LD-W of the listening device of a current information signal TLK-MES from another person (communication partner), here assumed to be the person TLK holding the personal communication device PCD. The perception measure SIG-MES (or a processed version thereof) is transmitted via the signal interface SIG-IF (see FIG. 1), in particular via transmitter S-Tx (see also FIG. 1C), of the listening device LD to the personal communication device PCD and presented on a display VID. In an embodiment, the system is adapted to also allow a communication from the personal communication device PCD to the listening device LD, e.g. via said wireless link WLS (or via another wired or wireless transmission channel), said communication link preferably allowing audio signals and possibly control signals to be transmitted, preferably exchanged between the personal communication device PCD to the listening device LD. In such embodiment, the listening device additionally comprises a receiver (S-Rx, not shown) to allow a bi-directional link to be established.

Speech Intelligibility Feedback and Optimization:

According to an embodiment of the present disclosure, the signal processing unit (DSP) of the listening device (e.g. a hearing instrument) is adapted to provide that the processing is determined by a continuous optimization scheme with the goal of maximizing the speech intelligibility, possibly in combination with other parameters such as sound quality and comfort. In an embodiment, the speech intelligibility (etc.) is adaptively maximized in dependence of the instantaneous sound picture, e.g. based on current (time dependent) data concerning speech intelligibility (e.g. in the form of a speech intelligibility measure) and possibly sound quality (e.g. in the form of a target signal to noise ratio).

In an embodiment, optimization depends on an adaptive strategy minimizing the cost function determined by lack of speech intelligibility. Speech intelligibility can be estimated by a variety of methods, and a number of objective measures have been proposed, see e.g. [Taal et al.; 2010]. Speech intelligibility calculations under noisy conditions, including stationary noises, and extensions to hearing impaired people are e.g. described in [Rhebergen and Versfeld; 2005]. US 2005/0141737A1 describes a method of adapting a processor transfer function to optimize the speech intelligibility in a particular sound environment.

In an embodiment, a speech quality measure comprises a speech intelligibility index calculation. When the predicted intelligibility is lower than a specified threshold, a number of actions are proposed as possible and relevant depending on user needs and preferences, e.g. selected among the following (e.g. implemented in a listening device during a fitting session and/or via a user interface):

1. A diode or similar visual indicator on the hearing instrument or an auxiliary device in communication with the hearing instrument may show that the hearing situation is difficult for this particular user right now. This could help the other persons present (this could for example be a teacher in a school or staff in a home for elderly people) to raise their voices, move closer or take other actions such as using a microphone or similar assistive device (connected to the hearing instrument) for improving the intelligibility for the hearing impaired person.
2. An audio signal may be emitted to the user indicating that some sort of action should be taken to improve the situation, e.g. to improve his or her position relative to the speaker. It is believed that such info could in some cases clarify to the hearing impaired that the situation is really adverse and thereby help preventing sensations of personal failure or inadequacy, bearing in mind that many severely hearing impaired people have a limited ability to correctly determine loudness of sound.
3. The level of speech intelligibility as indicated by the perception measure (software) could be logged in the hearing system for later use by the audiologist. Preferably, a calculated speech intelligibility measure is logged over time together with classifiers of the corresponding acoustic environment, e.g. wind noise, reverberation signal to noise ratio, voice activity, etc. as e.g. determined by corresponding detectors (wind noise-, reverberation-, signal to noise ratio- (S/N), voice activity-detectors (VAD), etc.).
4. In situations with binaural fitting and ear-to-ear communication, data may be transferred from the hearing instrument with the best predicted speech intelligibility to the other one, effectively sacrificing spatial data over speech intelligibility.
5. In situations with direct or indirect communication between hearing instrument and cellphone or similar device, the cellphone may contain an APP or similar software displaying the instantaneous and/or averaged data related to speech intelligibility and possibly other relevant data as calculated in the hearing aid. Alternatively, the described data may be calculated from information transmitted from hearing instrument to the cellphone on behalf of the hearing aid and the result may be transmitted back to the hearing aid.

Figure 6:
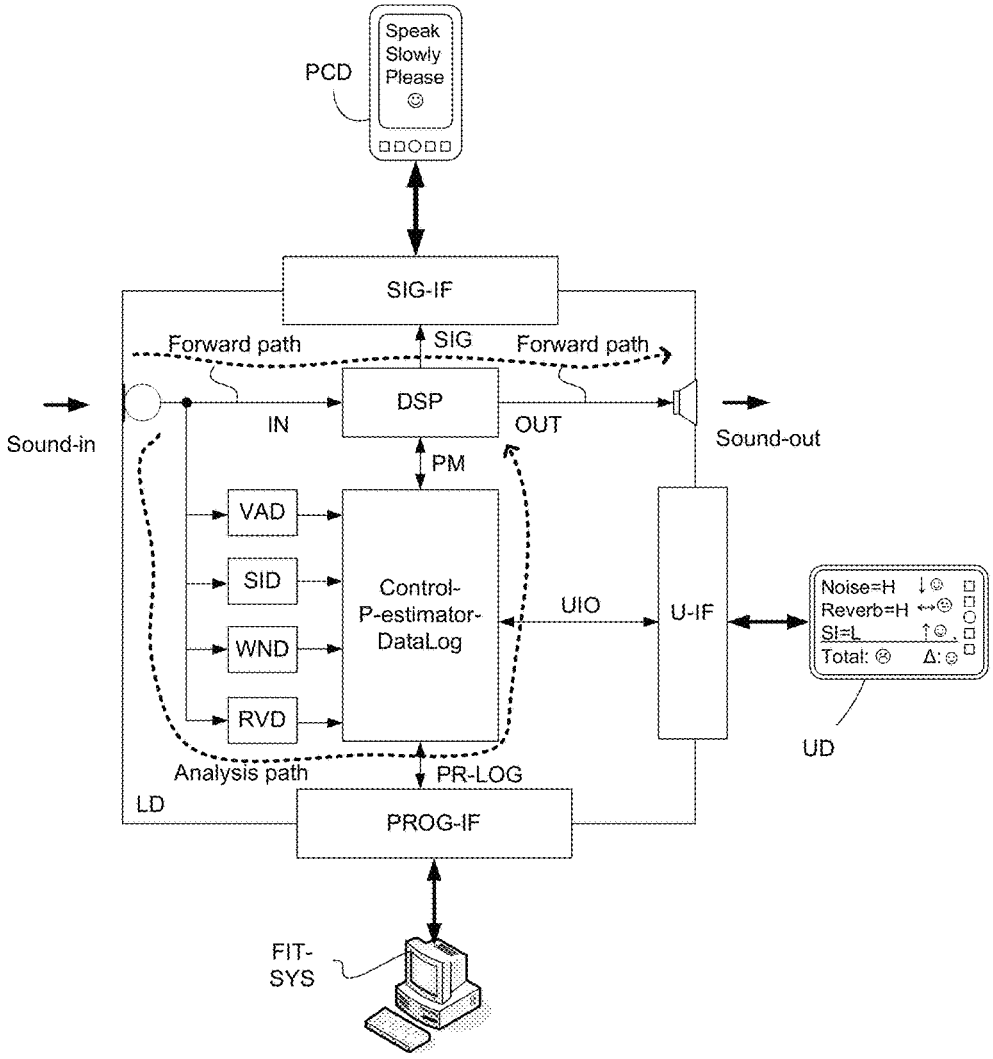
FIG. 6 shows an embodiment of a listening system comprising a listening device comprising an interface to an auxiliary device intended for another person, an interface to a display unit intended for the user of the listening system, and a programming interface for connecting the listening device to a fitting system.

FIG. 6 illustrates some of the above mentioned features. FIG. 6 shows an embodiment of a listening system comprising a listening device (LD) comprising an interface (SIG-IF) to an auxiliary device (PCD) intended for another person than the user of the listening device, an interface (U-IF) to an auxiliary device (UD) intended for the user, and a programming interface (PROG-IF) for connecting the listening device to a fitting system (FIT-SYS). The listening device (LD) comprises a forward path (Forward path) comprising a microphone for converting an input sound (Sound-in) to an electric input signal (IN) comprising an information signal (e.g. speech), a signal processing unit (DSP) for processing the electric input signal (or a signal derived therefrom) and providing a processed output signal (OUT), and a loudspeaker for converting an electric output signal to an output sound (Sound-out).

The listening device further comprises an analysis path (Analysis path) comprising a control unit for analysing signals of the forward path and for controlling the processing of the forward path (to dynamically optimize processing for maximum speech intelligibility).

To be able to dynamically evaluate/estimate speech intelligibility (in a prevailing acoustic environment of the user/listening device), the listening device (LD) comprises a number of detectors. The various detectors typically use a signal of the forward path as input, e.g. the electric input signal (IN) or a signal originating therefrom (e.g. a signal from the signal processing unit (DSP) or the processed output signal (OUT)). Alternatively or additionally, a detector may use a signal from the forward path AND/OR one or more output signals from one or more other detectors (e.g. a speech intelligibility detector may use an input from a voice activity detector (VAD), so that it only estimates intelligibility, when a voice is detected in the input signal by the VAD).

The embodiment of a listening device illustrated in FIG. 6 comprises a voice activity-detector (VAD) for determining whether or not an input signal comprises a voice signal (at a given point in time) (cf. e.g. WO9103042A1). This has the advantage that time segments of the electric microphone signal comprising human utterances (e.g. speech) in the user's environment can be identified, and thus separated from time segments only comprising other sound sources (considered as noise, e.g. including artificially generated noise). The listening device further comprises a speech intelligibility detector (SID) for analyzing a signal of the forward path (IN) and extracting a parameter related to speech intelligibility (cf. e.g. EP2372700A1). In an embodiment, the parameter relates to an estimate of the current amount of signal (target signal) and noise (non-target signal). The listening device further comprises a wind noise detector (WND) for detection of wind noise in an input signal (cf. e.g. EP1448016A1). The listening device further comprises a reverberation detector (RVD) for detecting a level of reverberation in an input signal (cf. e.g. EP2381700A1).

The listening device may further comprise a signal to noise ratio detector (S/N) e.g. for determining a noise component of a noisy (target) signal.

In a further embodiment, the listening device comprises a level detector for determining the level of an input signal (e.g. on a band level and/or of the full (wide band) signal). The input level of the electric microphone signal picked up from the user's acoustic environment is e.g. a classifier of the environment.

In an embodiment, the listening device comprises a detector of brain waves to indicate present state of mind or cognitive load of a user wearing the listening device (e.g. using EEG-electrodes on a shell or housing part of the hearing assistance device, cf. e.g. EP2200347A2, and FIG. 1, 2).

The listening device (LD) further comprises a control unit operatively connected to the signal processing unit (DSP) and to a perception unit and configured to control the signal processing unit depending on the perception measure. In the embodiment of FIG. 6, the control unit (Control-P-estimator-DataLog) is integrated with the perception unit (cf. unit P-estimator in FIG. 1) for establishing a perception measure PM indicative of the wearer's present ability to perceive an information signal (including the intelligibility of an input signal IN). The control unit (Control-P-estimator-DataLog) is configured to adaptively maximize the speech intelligibility in dependence of the instantaneous sound picture (as indicated by the available detectors, here VAD, SID, WND, RVD). The signal PM is dynamically updated to indicate a current level of speech intelligibility and is fed to the signal processing unit (DSP) and used in the selection of appropriate processing algorithms applied to the information signal IN. Thereby an adaptive control of the signal processing can be provided to optimize a user's speech intelligibility.

As described in connection with FIG. 1, the perception measure PM from the perception unit (P-estimator) is used in the signal processing unit (DSP) to generate a control signal SIG to signal interface (SIG-IF) to present to another person or another device a message indicative of the wearer's current ability to perceive an information message from another person, as e.g. shown in a display of a SmartPhone (PCD) (Speak Slowly Please ☺).

The listening device (LD) comprises an interface (U-IF) to an auxiliary device (UD) intended for the user (e.g. including a display unit and/or an audio output). An audio signal may be emitted to the user via the interface, e.g. initiated by the control unit (Control-P-estimator-DataLog) via signal UIO to the user interface (U-IF). As illustrated in FIG. 6, information regarding the present acoustic environment (here Noise=high, Reverb=high, SI=low) may alternatively or additionally be communicated to the user via a display of the user device (UD), e.g. a remote control device, e.g. a SmartPhone. In an embodiment, the user device (UD) is configured to allow the user to indicate a measure of speech intelligibility to the listening device (e.g. to the Control-P-estimator-DataLog unit) via the user interface, e.g. via a touch sensitive display of the remote control device or SmartPhone. In an embodiment, the feedback from the user via the user interface may modify the perception measure in the listening device.

Preferably, the auxiliary device is configured to indicate to the wearer (user) of the listening device and/or to another person (a communication partner) any changes in the perception measure. This has the advantage that the user and/or the communication partner is immediately informed whether the perception for the user is/can be influenced by actions of the user and/or communication partner. In an embodiment, the indication comprises a graphical illustration. In an embodiment (e.g. referring to FIG. 6), the indication of changes in the perception measure is indicated to the user via a user interface (U-IF), e.g. on a display of the auxiliary device (UD, e.g. a SmartPhone of the user). In an embodiment (e.g. referring to FIG. 6), the indication of changes in the perception measure is indicated to the communication partner via the signal interface (SIG-IF), e.g. on a display of the auxiliary device (PCD, e.g. a SmartPhone of the communication partner). In the example of FIG. 6, the current level of as well as changes to the perception measure and to individual classifiers of the acoustic environment are indicated on the user's auxiliary device (e.g. a SmartPhone). The respective overall current level (Total: in FIG. 6) and changes to the current level (Δ: in FIG. 6) of perception of the user of the electric input signal as estimated by the perception measure and its change with respect to time is indicated by a 'smiley' (e.g. good ☺, neutral 😐, bad ☹). The current values of individual classifiers and their current change with time are indicated by a level indicator (H=High, M=Medium, L=low) and an arrow-smiley combination indicating the current changes over time (e.g. ↑ ☺, ↔ 😐, and ↓ ☹), in case a higher value of the classifier is intended/wished). Thereby an instant feedback to the user can be provided (and correspondingly to a communication partner, if the same or equivalent information is conveyed to his or her auxiliary device, e.g. a SmartPhone).

In the embodiment of FIG. 6, the listening device, here the control unit (Control-P-estimator-DataLog), comprises a data logging capability. In an embodiment, corresponding values of speech intelligibility measures, and detector inputs (or classifiers of the acoustic environment derived from the detector inputs) at different points in time are logged. The logged data can be transferred to a fitting system (FIT-SYS) by signal PR-LOG and programming interface (PROG-IF) for connecting the listening device to the fitting system for further analysis (e.g. by an audiologist). The logged data and their further processing can e.g. be used to improve a setting of signal processing parameters, which can be subsequently uploaded to the listening device via the programming interface.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

[Binns and Culling; 2007]. Binns C, and Culling J F, The role of fundamental frequency contours in the perception of speech against interfering speech. J Acoust Soc. Am 122 (3), pages 1765, 2007.

[Bregman, 1990], Bregman, A. S., "Auditory Scene Analysis—The Perceptual Organization of Sound," Cambridge, Mass.: The MIT Press, 1990.

EP2200347A2 (OTICON) 23 Jun. 2010.

EP2372700A1 (OTICON) 5 Oct. 2011.

[Jørgensen and Dau; 2011] Jørgensen S, and Dau T, Predicting speech intelligibility based on the signal-to-noise envelope power ratio after modulation-frequency selective processing. J Acoust Soc. Am 130 (3), pages 1475-1487, 2011.

[Lan et al.; 2007] Lan T., Erdogmus D., Adami A., Mathan S. & Pavel M. (2007), Channel Selection and Feature Projection for Cognitive Load Estimation Using Ambulatory EEG, Computational Intelligence and Neuroscience, Volume 2007, Article ID 74895, 12 pages.

[Lunner; 2012] EPxxxxxxxAx (OTICON) Patent application no. EP 12187625.4 entitled Hearing device with brain-wave dependent audio processing filed on 29 Oct. 2012.

[Mesgarani and Chang; 2012] Mesgarani N, and Chang E F, Selective cortical representation of attended speaker in multi-talker speech perception. Nature. 485 (7397), pages 233-236, 2012.

[Pascal et al.; 2003] Pascal W. M. Van Gerven, Fred Paas, Jeroen J. G. Van Merriënboer, and Henrik G. Schmidt, Memory load and the cognitive pupillary response in aging, Psychophysiology. Volume 41, Issue 2, Published Online: 17 Dec. 2003, Pages 167-174.

[Pasley et al.; 2012] Pasley B N, David S V, Mesgarani N, Flinker A, Shamma S A, Crone N E, Knight R T, and Chang E F, Reconstructing speech from human auditory cortex. PLoS. Biol. 10 (1), pages e1001251, 2012.

[Roweis, 2001] Roweis, S. T. One Microphone Source Separation. Neural Information Processing Systems (NIPS) 2000, pp. 793-799 Edited by Leen, T. K., Dietterich, T. G., and Tresp, V. Denver, Colo., US, MIT Press. 2001.

[Schaub; 2008] Arthur Schaub, Digital hearing Aids, Thieme Medical. Pub., 2008.

[Vongpaisal and Pichora-Fuller; 2007] Vongpaisal T, and Pichora-Fuller M K, Effect of age on F0 difference limen and concurrent vowel identification. J Speech Lang. Hear. Res. 50 (5), pages 1139-1156.

[Wolpaw et al.; 2002] Wolpaw J. R., Birbaumer N., McFarland D. J., Pfurtscheller G. & Vaughan T. M. (2002), Braing computer interfaces for communication and control, Clinical Neurophysiology, Vol. 113, 2002, pp. 767-791.

[Wright et al.; 2002] Kenneth P. Wright Jr., Joseph T. Hull, and Charles A. Czeisler (2002), Relationship between alertness, performance, and body temperature in humans, Am. J. Physiol. Regul. Integr. Comp. Physiol., Vol. 283, Aug. 15, 2002, pp. R1370-R1377.

US 2007/147641 A1 (PHONAK) 28 Jun. 2007.

US 2008/036574 A1 (OTICON) 14 Feb. 2008.

EP2023668A2 (SIEMENS MEDICAL) 11 Feb. 2009

WO2012152323A1 (ROBERT BOSCH) 15 Nov. 2012

[Taal et al., 2010] Cees H. Taal, Richard C. Hendriks, Richard Heusdens, Jesper Jensen, A short-time objective intelligibility measure for time-frequency weighted noisy speech, ICASSP 2010, pp. 4214-4217.

[Rhebergen and Versfeld; 2005] Koenraad S. Rhebergen, Niek J. Versfeld A speech intelligibility index-based approach to predict the speech reception threshold for sentences in fluctuating noise for normal hearing listeners, J. Acoust. Soc. Am., Vol. 117(4), April, 2005, pp. 2181-2192.

US 2005/0141737A1 (WIDEX) 30 Jun. 2005.

WO9103042A1 (OTWIDAN) 7 Mar. 1991.

EP1448016A1 (OTICON) 18 Aug. 2004.

EP2381700A1 (OTICON) 26 Oct. 2011.

EP2200347A2 (OTICON) 23 Jun. 2010.

The invention claimed is:

1. A listening device for processing an electric input sound signal and to provide an output stimulus perceivable to a wearer of the listening device as sound, the listening device comprising:

a signal processing unit for processing an information signal comprising speech originating from the electric input sound signal according to the wearer's hearing impairment and to provide a processed output signal forming a basis for generating said output stimulus;

a forward path being defined by the signal processing unit;

a perception unit for establishing a perception measure indicative of the wearer's present ability to perceive said information signal as speech; and a signal interface for communicating said perception measure to another person or an auxiliary device, wherein the listening device is configured to measure brain activity of the wearer via EEG signals detected by electrodes located inside the wearer's ear canal, the measured brain activity being used by the listening device to estimate how much effort the wearer uses to segregate and understand speech and noise signals present in the output stimulus, wherein the listening device further comprises a load estimation unit for providing an estimate of present cognitive load of the wearer based on the measured brain activity, the perception unit is adapted to use the estimate of present cognitive load of the wearer to determine the perception measure, the load estimation unit is configured to base the estimate of present cognitive load of the wearer on said EEG-signals, and the signal processing unit, the perception unit, and the signal interface are worn on the wearer's head at or proximate to the ear, wherein the signal processing unit is adapted so that the processing of the signal processing unit is determined by a continuous optimization scheme with a goal of maximizing speech intelligibility, and wherein, according to the continuous optimization scheme, the speech intelligibility is adaptively maximized in dependence of a detected instantaneous sound picture and the estimate of the present cognitive load.

2. The listening device according to claim 1 adapted to influence the processing of said information signal in dependence of the perception measure.

3. The listening device according to claim 1, further comprising:

an ear part adapted for being mounted fully or partially at an ear or in an ear canal of the wearer, the ear part comprising a housing, at least one electrode located at a surface of said housing to allow said electrode(s) to contact the skin of the wearer when said ear part is operationally mounted on the user, the at least one electrode being adapted to pick up a low voltage electric signal from the wearer's brain, and an amplifier unit operationally connected to said electrode(s) and adapted for amplifying said low voltage electric signal(s) to provide amplified brain signal(s).

4. The listening device according to claim 3, configured to analyze said low voltage electric signals from the wearer's brain or said amplified brain signal(s) to estimate which of the individual sound signals the wearer presently attends to.

5. The listening device according to claim 1, further comprising:

a source separation unit configured to separate the input sound signal in individual sound signals each representing an individual acoustic source in the current local environment of the wearer wearing the listening device.

6. The listening device according to claim 1 wherein the perception unit is adapted to analyze a signal of the forward path and extract a parameter related to speech intelligibility and to use such parameter in the determination of said perception measure.

7. The listening device according to claim 1 comprising an SNR estimation unit for estimating current signal to noise ratio, and wherein the perception unit is adapted to use the estimate of current signal to noise ratio in the determination of the perception measure.

8. The listening device according to claim 1 wherein the perception unit is adapted to analyze inputs from one or more sensors related to a signal of the forward path and/or to the environment of the user or a current communication partner and to use the result of such analysis in the determination of said perception measure.

9. The listening device according to claim 1 wherein the signal interface comprises a light indicator adapted to issue a different light indication depending on the current value of the perception measure.

10. The listening device according to claim 1 wherein the signal interface comprises a structural part of the listening device which changes visual appearance depending on the current value of the perception measure, wherein the visual appearance is a color, a color tone, a form, or a size.

11. The listening device of claim 10 wherein the structural part comprises a smart material.

12. The listening device of claim 10 wherein the structural part comprises a polymer whose color can be controlled by a voltage indicative of the perception measure.

13. The listening device according to claim 1 wherein the signal interface comprises a wireless transmitter for transmitting the perception measure or a processed version thereof to the auxiliary device for being presented there.

14. The listening device according to claim 1 comprising a control unit for analysing signals of the forward path, the control unit being operatively connected to the signal processing unit and to the perception unit and configured to dynamically optimize the processing of the signal processing unit to maximize speech intelligibility.

15. The listening device according to claim 1 comprising a memory for storing data, and wherein the listening device is configured to store corresponding values of said perception measure together with one or more classifiers of the current acoustic environment at different points in time.

16. Use of the listening device as claimed in claim 1 in a hearing instrument, a headset, an ear phone, an active ear protection system or a combination thereof.

17. A listening system comprising the listening device as claimed in claim 1 and an auxiliary device, wherein the listening device and the auxiliary device comprise a communication interface allowing to establish a communication link between the listening device and the auxiliary device to provide that information can be exchanged or forwarded from one to the other, at least so that the perception measure or a processed version thereof can be transmitted from the listening device to the auxiliary device.

18. The listening system according to claim 17 wherein the auxiliary device comprises an information unit to display or otherwise present the perception measure or a processed version thereof to a person wearing or otherwise being in the neighbourhood of the auxiliary device, and/or to control functionality of the listening system.

19. The listening system according to claim 17 comprising a pair of listening devices each according to claim 1, the pair of listening devices constituting a binaural listening system enabling an exchange of information, including audio signals, between them, configured to transfer audio data from the listening device with the best predicted speech intelligibility as indicated by the current perception measure to the other listening device.

20. The listening system according to claim 17 wherein the auxiliary device is configured to run an APP or software for displaying instantaneous and/or averaged data related to said perception measure.

21. The listening system according to claim 20 wherein the auxiliary device is configured to indicate to the wearer of the listening device and/or to another person any changes in the perception measure.

22. The listening system according to claim 17, wherein the listening device is a hearing aid.

23. The listening device according to claim 1, comprising: a hearing aid.

24. The listening device of claim 1 wherein the speech intelligibility is adaptively maximized in dependence of current data concerning speech intelligibility.

25. The listening device of claim 24 wherein the speech intelligibility is adaptively maximized in dependence of a speech intelligibility measure.

26. The listening device of claim 1 wherein the signal processing unit is adapted so that the processing is determined by a continuous optimization scheme with a goal of maximizing speech intelligibility in combination with sound quality.

27. A method of operating a listening device for processing an electric input sound signal according to a wearer's hearing impairment and for providing an output stimulus perceivable to the wearer of the listening device as sound, the listening device comprising a signal processing unit for processing an information signal comprising speech originating from the electric input sound signal according to said impairment and to provide a processed output signal forming a basis for generating said output stimulus, the method comprising:

establishing, by a perception unit inside the listening device, a perception measure indicative of the wearer's present ability to perceive said information signal as speech;

using a signal interface in the listening device to communicate said perception measure to another person or an auxiliary device;

measuring brain activity of the wearer via EEG signals detected by electrodes located inside the wearer's ear canal; and estimating based on the measured brain activity how much effort the wearer uses to segregate and understand speech and noise signals present in the output stimulus, wherein the method further comprises providing an estimate of present cognitive load of the wearer based on the measured brain activity, the step of establishing a perception measure uses the estimation of present cognitive load of the wearer to determine the perception measure, the estimation of present cognitive load of the wearer is based on said EEG-signals, and the signal processing unit, the perception unit, and the signal interface are worn on the wearer's head at or proximate to the ear, wherein the signal processing unit is adapted so that the processing of the signal processing unit is determined by a continuous optimization scheme with a goal of maximizing speech intelligibility, and wherein, according to the continuous optimization scheme, the speech intelligibility is adaptively maximized in dependence of a detected instantaneous sound picture and the estimate of the present cognitive load.

28. A data processing system comprising a processor and instructions encoded on a tangible non-transitory recording medium for causing the processor to perform the steps of the method of claim 27.

* * * * *